US005642532A

United States Patent [19]

Morant

[11] Patent Number: 5,642,532

[45] Date of Patent: Jul. 1, 1997

[54] SELF-RAISING COMMODE SEAT

[76] Inventor: Stephen P. Morant, 3304 Ole Miss Dr., Kenner, La. 70065

[21] Appl. No.: 607,879

[22] Filed: Feb. 27, 1996

[51] Int. Cl.[6] ..... A47K 13/10

[52] U.S. Cl. ..... 4/246.1; 4/241

[58] Field of Search ..... 4/246.1, 248, 246.3, 4/241

[56] References Cited

U.S. PATENT DOCUMENTS

| | | | |
|---|---|---|---|
| 622,383 | 4/1899 | O'Brien | 4/241 |
| 1,045,927 | 12/1912 | Zeleny et al. | 4/241 |
| 1,681,277 | 8/1928 | Boots | 4/241 |
| 2,812,522 | 11/1957 | Wilson | 4/241 |
| 2,877,469 | 3/1959 | Johnson | 4/241 |
| 3,414,911 | 12/1968 | Enlow | 4/241 |
| 5,341,518 | 8/1994 | Uhl | 4/236 |

*Primary Examiner*—David J. Walczak
*Attorney, Agent, or Firm*—Joseph N. Breaux

[57] ABSTRACT

A commode seat raising mechanism including a commode seat; a biasing mechanism in connection between a top wall of a commode and the commode seat for biasing the commode seat in an upright position; and a dampening mechanism in connection between the commode seat and the biasing mechanism for adjusting the rate at which the commode seat is raised.

1 Claim, 1 Drawing Sheet

SELF-RAISING COMMODE SEAT

TECHNICAL FIELD

The present invention relates to devices for automatically raising a commode seat and more particularly to devices for automatically raising a commode seat that raise the seat in a slow and controlled manner preventing the seat from hitting a user.

BACKGROUND ART

It has long been recognized that for purposes of sanitation commode seats should be raised when not in use. In public toilets particularly, the need has long existed for a suitable self-raising commode seats.

Many attempts have been made to supply a seat of this general character, but these attempts have resulted in seats which require alterations to the existing commode and which rise quickly striking the user when departing from the commode. It would be a benefit, therefore, to have a self-raising commode seat that is connectable to standard commodes. It would be a further benefit to have a self-raising commode seat that has a dampening mechanism for slowing the rising action of the seat preventing the seat from striking a user. It would be a still further benefit to have a self-raising commode seat which is inexpensive and dependable.

GENERAL SUMMARY DISCUSSION OF INVENTION

It is thus an object of the invention to provide a self-raising commode seat that has a biasing mechanism for biasing the commode seat in an upright position.

It is a further object of the invention to provide a self-raising commode seat that has a dampening mechanism for slowing the rate at which the commode seat is raised to an upright position.

It is a still further object of the invention to provide a self-raising commode seat that is connectable to standard commodes.

It is a still further object of the invention to provide a self-raising commode seat that is inexpensive and dependable.

Accordingly, a self-raising commode seat of the type connectable to a standard commode is provided. The self-raising commode seat includes: a commode seat; a biasing mechanism in connection between a top wall of a commode and the commode seat for biasing the commode seat in an upright position; and a dampening mechanism in connection between the commode seat and the biasing mechanism for adjusting the rate at which the commode seat is raised.

The self-raising commode seat may be connected to standard commodes found in homes and in public restrooms or adapted for use with specific commode designs. Further, the self-raising commode seat may be adapted for use with commodes having a cover.

The biasing mechanism includes a first and a second flange bolt which are connected to the top wall of the commode in the same manner and location as conventional commode seats and covers. The biasing mechanism further includes an elongated shaft having a first threaded end ridgedly connected to the first flange bolt. The second threaded end of the shaft is disposed through and extends beyond the second bolt flange. A spring is coiled about the shaft and has a second end section ridgedly connected to the shaft. The first end section of the spring is in operational contact with the commode seat. "Operational contact" is defined to include the numerous means of connecting the first end section to the seat so that as the spring is allowed to expand the commode seat is biased in an upright position in relation to the commode. The first end section may be located below the commode seat or may be rigidly connected thereto.

The dampening mechanism includes a tension adjusting mechanism threadably connected to the second threaded end of the shaft for increasing and decreasing the friction between the first flange bolt and the commode seat and the second flange bolt and the commode seat. To decrease the rate at which the seat rises the tension adjusting mechanism is threaded up against the second flange bolt so that the friction between the flange bolts and the rising commode seat is increased. The dampening mechanism may further include a pad between either the first flange bolt and the seat or the second flange bolt and the seat. Preferably, a pad is mounted between both flange bolts and the seat. The pads may be rubber or plastic washers mounted on the shaft. However, the pads may be constructed of any material which is slightly compressible to increase the friction between the flange bolts and the seat.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
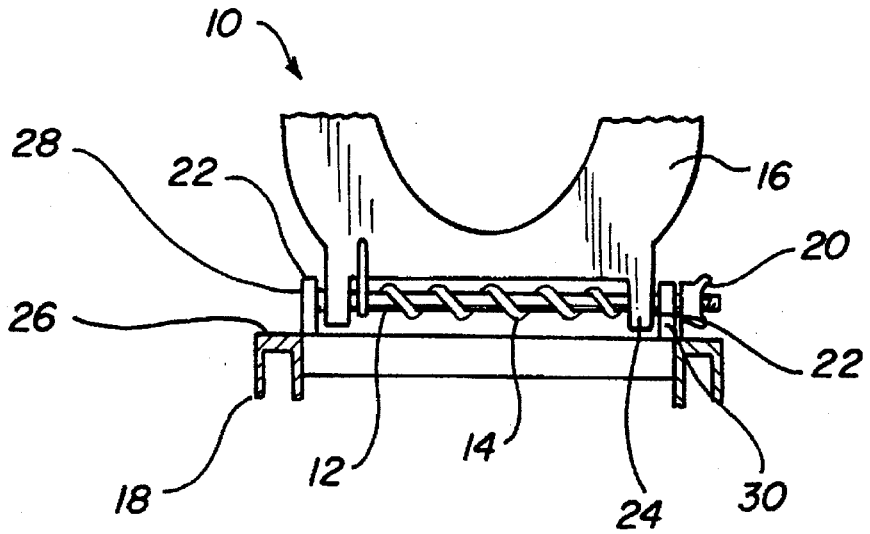
FIG. 1 is a partial section view of an exemplary embodiment of the self-raising commode seat of the present invention.

FIG. 1 is a partial section view of an exemplary embodiment of the self-raising commode seat of the present invention generally designated by the numeral 10. Self-raising commode seat 10 includes a biasing mechanism comprising a shaft 12 and a helical spring 14 in connection between a commode seat 16 and a commode 18 and a dampening mechanism comprising a tension adjusting mechanism 20 and a pair of pads 22.

Commode seat 16 is a conventional commode seat having a pair of connecting arms 24 for rotatably connecting seat 16 to shaft 12 of the biasing mechanism which is rigidly connected to commode 18. Shaft 12 is rigidly mounted on the top wall 26 of commode 18 between a first flange bolt 28 and a second flange bolt 30. Spring 14 is operationally connected between shaft 12 and seat 16 so that seat 16 is biased in an upright position.

Figure 2:
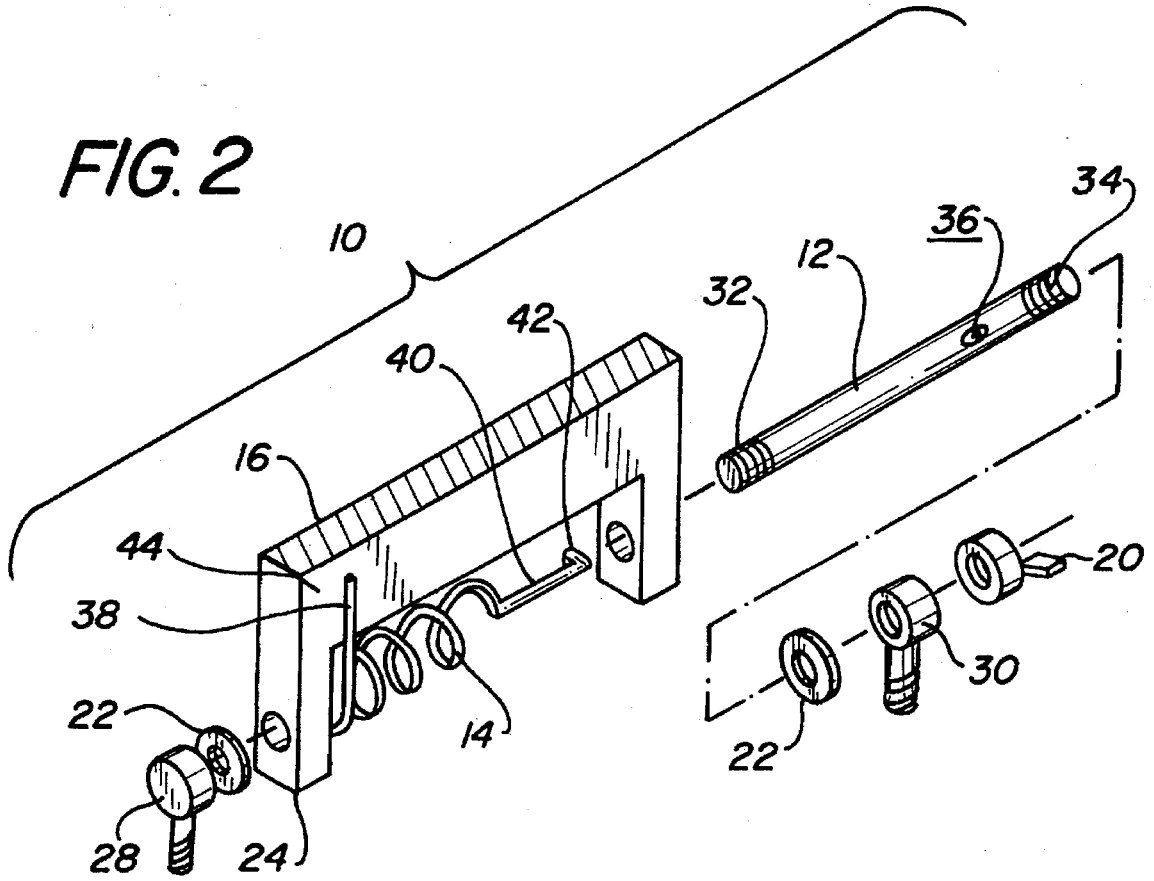
FIG. 2 is a an exploded view of the self-raising commode seat.

FIG. 2 is an exploded view of self-raising commode seat 10. Shaft 12 is an elongated metal member having a first and second threaded end 32, 34. Shaft 12 forms a hole 36 approximate second threaded end 34 for connecting spring 14 thereto. Shaft 12 is disposed through connecting arms 24 of seat 16 so that seat 16 may rotate relative thereto.

Spring 14 is a helical spring having a first end section 38 which extends substantially tangentially from the coiled portion of the spring 14. A second end section 40 extends substantially parallel to the longitudinal axis of spring 14.

Second end section 40 has a crook end 42 for disposing in hole 36 formed in shaft 12 rigidly connecting spring 14 to shaft 12. When shaft 12 is disposed through connecting arms 24 with spring 14 coiled thereabout, spring 14 is located between arms 24 with first end section 38 in operational contact with the bottom surface 44 of seat 16.

First and second flange bolts 28, 30 are connected to top wall 26 of commode 18 (see FIG. 1) in place of the conventional bolt hinges commonly found on commodes for rigidly connecting shaft 12 of the biasing mechanism thereto. First threaded end 32 of shaft 12 is threaded into first flange bolt 28 so that first end section 38 of spring 14 and seat 16 are biased in an upright position, substantially perpendicular to top wall 26 of commode 18 as shown in FIG. 1. The second threaded end 34 of shaft 12 is disposed through the bore 46 of second flange bolt 30. Pads 22 constructed of rubber are mounted on shaft 12 between first bolt flange 28 and a connecting arm 24 and second bolt flange 30 and a connecting arm 24. Tension adjusting mechanism 20 is threaded onto second threaded end 34 of shaft 12 for adjusting the rate at which seat 16 is raised to the upright position. To slow the rate at which commode seat 16 rises tension adjusting mechanism 20 is threaded down increasing the friction between seat 16 and pads 22.

Use of self-raising commode seat 10 is now described with reference to FIGS. 1 and 2. With self-raising commode seat 10 connected to commode 18, seat 16 is maintained in an upright position. To lower seat 16 a user merely pushes seat 16 down, contracting spring 14 about shaft 12, and sits thereon. When the user departs from seat 16, spring 14 expands urging seat 16 to the upright position. To prevent seat 16 from rising too quickly and hitting the user, the user tightens tension adjusting mechanism 20 squeezing pads 22 between connecting arms 24 and first and second flange bolts 28,30 increasing the friction therebetween causing seat 16 to rise slowly.

It can be seen from the preceding description that a device for automatically raising a commode seat which has a biasing mechanism for biasing the commode seat in an upright position, a dampening mechanism for slowing the rate at which the commode seat is raised to an upright position, is connectable to standard commodes, and that is inexpensive and dependable has been provided.

It is noted that the embodiment of the self-raising commode seat described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A self-raising commode seat comprising:

a commode having a top wall having a first flange bolt having a threaded aperture and a second flange bolt having a bore formed therethrough;

a commode seat having a pair of spaced connecting arms;

a biasing mechanism in connection between said top wall of said commode and said commode seat for biasing said commode seat in an upright position, said biasing mechanism including a helical spring and a shaft, said helical spring having a coiled portion terminating in a first and second spring end, said coiled portion being positioned over a section of said shaft, said first spring end extending from said coiled portion in a direction tangential to said coiled portion terminating in contact with said commode seat, said shaft having a first threaded end, a second threaded end and a hole formed through the side thereof having said second spring end of said helical spring disposed therein, said first threaded end of said shaft being rigidly connected to said first flange bolt threaded aperture and said second threaded end of said shaft being positioned through said bore of said second flange bolt; and a dampening mechanism in connection between said commode seat and said biasing mechanism for adjusting the rate at which said commode seat is raised, said damping mechanism including a first pad positioned around said shaft and positioned between said first flange bolt and one of said pair of spaced connecting arms of said commode seat, a second pad positioned around said shaft and positioned between said second flange bolt and a remaining connecting arm of said pair of spaced connecting arms of said commode seat, and a tension adjusting mechanism threadably engaging said second threaded end of said shaft in a manner such that tightening said tension adjusting mechanism squeezes said first pad between said first flange bolt and said one of said pair of spaced connecting arms of said commode seat and said second pad between said second flange bolt and said remaining connecting arm of said commode seat.

* * * * *